US012667884B2

(12) United States Patent
Kato et al.

(10) Patent No.: US 12,667,884 B2
(45) Date of Patent: Jun. 30, 2026

(54) SAND MOLD-FORMING ADDITIVE, SAND MOLD-FORMING COMPOSITION, SAND MOLD MANUFACTURING METHOD, AND SAND MOLD

(71) Applicants: SINTOKOGIO, LTD., Nagoya (JP); TAKEMOTO YUSHI KABUSHIKI KAISHA, Gamagori (JP)

(72) Inventors: Yusuke Kato, Nagoya (JP); Toshihiko Zenpo, Nagoya (JP); Tomohiro Aoki, Nagoya (JP); Shumma Sato, Gamagori (JP)

(73) Assignees: SINTOKOGIO, LTD., Nagoya (JP); TAKEMOTO YUSHI KABUSHIKI KAISHA, Gamagori (JP)

( * ) Notice: Subject to any disclaimer, the term of this patent is extended or adjusted under 35 U.S.C. 154(b) by 407 days.

(21) Appl. No.: 18/282,536

(22) PCT Filed: Feb. 9, 2022

(86) PCT No.: PCT/JP2022/005078
§ 371 (c)(1),
(2) Date: Sep. 17, 2023

(87) PCT Pub. No.: WO2022/201931
PCT Pub. Date: Sep. 29, 2022

(65) Prior Publication Data

US 2024/0042513 A1 Feb. 8, 2024

(30) Foreign Application Priority Data

Mar. 23, 2021 (JP) ..... 2021-048156

(51) Int. Cl.
*B22C 1/02* (2006.01)
*B22C 1/18* (2006.01)
*B22C 9/02* (2006.01)

(52) U.S. Cl.
CPC ..... *B22C 1/02* (2013.01); *B22C 1/188* (2013.01); *B22C 9/02* (2013.01)

(58) Field of Classification Search
CPC ..... B22C 1/02; B22C 1/188; B22C 9/02
See application file for complete search history.

(56) References Cited

U.S. PATENT DOCUMENTS

2016/0059301 A1* 3/2016 Müller ..... B22C 1/24 164/525
2019/0105703 A1* 4/2019 Aoki ..... C04B 12/04
2022/0228067 A1* 7/2022 Sugaya ..... B22C 1/188

FOREIGN PATENT DOCUMENTS

CN 107573005 A 1/2018
CN 109982785 A 7/2019
JP S47026562 B1 7/1972
JP H09241927 A 9/1997
JP 2016215221 A 12/2016
JP 2017217660 A 12/2017
WO WO-03064577 A1 * 8/2003 ..... C11D 1/29
WO WO-2020246538 A1 * 12/2020 ..... C09K 23/04

OTHER PUBLICATIONS

PCT/JP2022/005078 International Search Report and Written Opinion dated Mar. 15, 2022 (8 p.).
PCT/JP2022/005078 International Preliminary Report on Patentability dated Oct. 5, 2023 (5 p.).
Chinese Office Action dated Dec. 17, 2025, for Chinese Application No. 202280022970.4 (8 p.).
English Translation of Chinese Office Action dated Dec. 17, 2025, for Chinese Application No. 202280022970.4 (7 p.).

* cited by examiner

*Primary Examiner* — Amber R Orlando
*Assistant Examiner* — Anastasia A. Kuvayskaya
(74) *Attorney, Agent, or Firm* — CONLEY ROSE, P.C.

(57) ABSTRACT

A sand mold-forming additive capable of making a sand mold-forming composition having excellent forming property and a sand mold having excellent moisture resistance is provided. The sand mold-forming additive contains 0.01-2.00 parts by weight of an inorganic alkali metal compound (B) per 100 parts by weight of anionic surfactant (A). The inorganic alkali metal compound (B) is at least one selected from sodium chloride and sodium sulfate. The ionic surfactant (A) is preferably at least one selected from alkyl sulfonic acid metal salts (A1), alkyl sulfuric acid metal salts (A2), and polyoxyalkylene alkyl ether sulfuric acid ester metal salts (A3).

14 Claims, No Drawings

SAND MOLD-FORMING ADDITIVE, SAND MOLD-FORMING COMPOSITION, SAND MOLD MANUFACTURING METHOD, AND SAND MOLD

CROSS-REFERENCE TO RELATED APPLICATIONS

The present application is a 35 U.S.C. § 371 U.S. National Phase entry of, and claims priority to, PCT Application PCT/JP2022/005078 filed Feb. 9, 2022, which claims priority to Japanese Patent Application No. 2021-048156 filed Mar. 23, 2021, each of which is hereby incorporated herein by reference in its entirety for all purposes.

STATEMENT REGARDING FEDERALLY SPONSORED RESEARCH OR DEVELOPMENT

Not applicable.

BACKGROUND

The present disclosure relates to sand mold-forming additives, sand mold-forming compositions, sand mold manufacturing methods, and sand molds.

Conventionally, a collapsible sand mold is used to manufacture a casting having a hollow portion. Also, in a case where a hollowed casting having a complicated internal structure is manufactured, it is known that since a high filling property is required for a composition which is the material of a mold, a foaming agent is used to foam the composition to enhance fluidity thereof.

Sand molds often contain alkali silicates as a main component of a binder. However, sand molds made by foamed compositions generally have low moisture resistance, so that moisture absorption may reduce the strength thereof. Therefore, a composition having an improved moisture resistance is provided by containing a specific lithium salt or an ionic compound that is ion-exchanged or gelled with an alkali silicate as a moisture resistant agent (see JP 2017-217660 A and JP 2016-215221 A).

However, when the moisture resistant agent described above is added to the composition, the moisture resistance of the sand mold is improved, but the composition is less likely to foam, thereby decreasing the fluidity thereof. Accordingly, there has been a need for improved sand mold-forming additives.

SUMMARY

One aspect of this disclosure is a sand mold-forming additive characterized by containing 0.01-2.00 parts by weight of an inorganic alkali metal compound (B) described below per 100 parts by weight of an ionic surfactant (A).

Inorganic Alkali Metal Compound (B): At Least One Selected from Sodium Chloride and Sodium Sulfate A second aspect of this disclosure is the sand mold-forming of the first aspect, wherein the ionic surfactant (A) comprises at least one selected from the following alkyl sulfonate metal salt (A1), the following alkyl sulfuric acid metal salt (A2), and the following polyoxyalkylene alkyl ether sulfuric acid ester metal salt (A3).

Alkyl sulfonic acid metal salt (A1): alkyl sulfonic acid metal salt having a C8-C22 alkyl group Alkyl sulfuric acid metal salt (A2): alkyl sulfuric acid metal salt having a C8-C22 alkyl group Polyoxyalkylene alkyl ether sulfuric acid ester metal salt (A3): polyoxyalkylene alkyl ether sulfuric acid ester metal salt having a C8-C16 alkyl group A third aspect of this disclosure is the sand mold-forming additive of the second aspect, wherein the ionic surfactant (A) comprises the alkyl sulfonic acid metal salt (A1), the alkyl sulfuric acid metal salt (A2), and the polyoxyalkylene alkyl ether sulfuric acid ester metal salt (A3).

A fourth aspect of this disclosure is the sand mold-forming additive of the third aspect, wherein the alkyl sulfonic acid metal salt (A1) is 50-98 parts by weight, the alkyl sulfuric acid metal salt (A2) is 1-40 parts by weight, and the polyoxyalkylene alkyl ether sulfuric acid ester metal salt (A3) is 1-40 parts by weight per 100 parts by weight of the total content of the alkyl sulfonic acid metal salt (A1), the alkyl sulfuric acid metal salt (A2), and the polyoxyalkylene alkyl ether sulfuric acid ester metal salt (A3).

A fifth aspect of this disclosure is the sand mold-forming additive according to any one of the first to fourth aspects, further comprising the following lithium compound (C).

Lithium Compound (C): At Least One Selected from Lithium Silicate, Lithium Sulfate and Lithium Hydroxide A sixth aspect of this disclosure is the sand mold-forming additive of the fifth aspect, wherein the lithium compound (C) comprises lithium silicate and at least one selected from lithium sulfate and lithium hydroxide.

A seventh aspect of this disclosure is the sand mold-forming additive of the fifth or sixth aspect, comprising 10-2000 parts by weight of the lithium compound (C) per 100 parts by weight of the ionic surfactant (A).

An eighth aspect of this disclosure is the sand mold-forming additive according to any one of the fifth to seventh aspects, wherein the lithium compound (C) comprises at least lithium silicate, and the molar ratio ($SiO_2/Li_2O$) of the lithium silicate is equal to or more than 3.0 and is equal to or less than 5.0.

A ninth aspect of this dis closure is a sand mold-forming composition characterized by comprising the sand mold-forming additive according to any one of the first to eight aspects, sand, and the following silicate compound (D).

Silicate Compound (D): At Least One Selected from Sodium Silicate and Potassium Silicate A tenth aspect of this disclosure is the sand mold-forming composition of the ninth aspect, containing 2-100 parts by weight of the sand mold-forming additive per 100 parts by weight of the silicate compound (D).

An eleventh aspect of this disclosure is a sand mold manufacturing method, comprising a step A of molding the sand mold-forming composition according to the ninth or tenth aspect.

A twelfth aspect of this disclosure is the sand mold manufacturing method according to the eleventh aspect, wherein the step A comprises a step A1 of stirring and foaming the sand mold-forming composition of the ninth or tenth aspect, a step A2 of filling the foamed sand mold-forming composition into a molding space, and a step A3 of solidifying the filled sand mold-forming composition.

A thirteenth aspect of this disclosure is a sand mold manufacturing method, comprising: a step B1 of adding the silicate compound (D) to the sand mold-forming additive according to any one of the first to eight aspects, stirring and foaming the mixture, and then adding the sand to the mixture to prepare the sand mold-forming composition according to the ninth or tenth aspect; a step B2 of filling the prepared sand mold-forming composition into a molding space; and a step B3 of solidifying the filled sand mold-forming composition.

A fourteenth aspect of this disclosure is a sand mold characterized by containing a sand mold-forming additive according to any one of the first to eight aspects, the following silicate compound (D), and sand.

Silicate Compound (D): At Least One Selected from Sodium Silicate and Potassium Silicate The numerical range shown herein by "Y-Z" represents a range including the upper and lower limits thereof. That is, "Y-Z" means "Y or more and Z or less."

According to the present disclosure, it is possible to provide a sand mold-forming additive for obtaining both a sand mold-forming composition having excellent foaming property and a sand mold having excellent moisture resistance. It is also possible to provide the sand mold-forming composition having excellent foaming property, the sand mold having excellent moisture resistance, and a method for producing the sand mold having excellent moisture resistance.

DETAILED DESCRIPTION

<Sand Mold-Forming Additive>

The sand mold-forming additive contains an ionic surfactant (A) and an inorganic alkali metal compound (B). Preferably, the sand mold-forming additive further comprises a lithium compound (C).

The sand mold-forming additive is mixed with sand together with a silicate compound (D) that is a binder, so as to form a sand mold-forming composition that is a material for a sand mold.

<Ionic Surfactant (A)>

Well-known ionic surfactants can be used as the ionic surfactant (A) and can be used alone or in combination. The sand mold-forming additive preferably contains at least one selected from alkyl sulfonic acid metal salt (A1), alkyl sulfuric acid metal salt (A2), and polyoxyalkylene alkyl ether sulfuric acid ester metal salt (A3), as the ionic surfactant (A). The sand mold-forming additive more preferably includes at least two of (A1) to (A3), and most preferably includes all three of (A1) to (A3), in order to improve the foaming property thereof.

<Alkyl Sulfonic Acid Metal Salt (A1)>

Alkyl sulfonic acid metal salts each having a C8-C22 alkyl group can be used as the alkyl sulfonic acid metal salt (A1) and can be used alone or in combination. The alkyl group has more preferably 8-18 carbon atoms. Examples of the metal salt of the alkyl sulfonic acid metal salt (A1) include, for example, an alkali metal salt such as a lithium salt, a sodium salt, and a potassium salt, an alkaline earth metal salt such as a calcium salt and a magnesium salt. Preferably, it is the sodium salt. Concrete examples of alkyl sulfonic acid metal salts (A1) include, for example, sodium nonanesulfonate, calcium decanesulfonate, sodium dodecanesulfonate, potassium tridecanesulfonate, lithium tetradecanesulfonate, sodium pentadecanesulfonate, calcium hexadecanesulfonate, lithium heptadecanesulfonate, calcium octadecanesulfonate, potassium icosanesulfonate, and sodium docosan sulfonate. The alkyl group of the alkyl sulfonic acid metal salt (A1) may be either a straight chain or a branched chain.

<Alkyl Sulfuric Acid Metal Salt (A2)>

Alkyl sulfuric acid metal salts each having a C8-C22 alkyl group can be used as the alkyl sulfuric acid metal salt (A2) and can be used alone or in combination. The alkyl group more preferably has 8-18 carbon atoms. Examples of the metal salt of the alkyl sulfuric acid metal salt (A2) include, for example, an alkali metal salt such as a lithium salt, a sodium salt, and a potassium salt, an alkaline earth metal salt such as a calcium salt and a magnesium salt. Preferably, it is the sodium salt. Concrete examples of the alkyl sulfuric acid metal salt (A2) include sodium octyl sulfate, calcium nonyl sulfate, lithium decyl sulfate, sodium undecyl sulfate, potassium dodecyl sulfate, sodium tridecyl sulfate, calcium tetradecyl sulfate, lithium pentadecyl sulfate, sodium hexadecyl sulfate, heptadecyl sulfate, sodium octadecyl sulfate, sodium icosa sulfate, and sodium docosa sulfate. The alkyl group of the alkyl sulfuric acid metal salt (A2) may be either a straight chain or a branched chain.

<Polyoxyalkylene Alkyl Ether Sulfuric Acid Ester Metal Salt (A3)>

Polyoxyalkylene alkyl ether sulfuric acid ester metal salts each having a C8-C16 alkyl group can be used as the polyoxyalkylene alkyl ether sulfuric acid ester metal salt (A3) and can be used alone or in combination. The structure and the number of moles of the added alkylene oxides of polyoxyalkylene alkyl ether sulfuric acid ester metal salts (A3) are not particularly limited.

For example, a compound represented by the following formula (1) can be used as the polyoxyalkylene alkyl ether sulfuric acid ester metal salt (A3).

$$R_1—O—(C_nH_{2n}O)_m—SO_3X \qquad \text{Formula (1):}$$

($R_1$ is a C8-C16 alkyl group, n is an integer of 2-4, m is 1-10, and X is an alkali metal or alkaline earth metal.)

In the formula (1), the carbon number of $R_1$ is preferably 10-14, and $R_1$ may be either a straight chain or a branched chain. In the formula (1), n is preferably 2 or 3, and is more preferably 2. In the formula (1), m is the average number of moles of polyoxyalkylene groups, is preferably 2-6, and is more preferably 3-4. Examples of X in the formula (1) include lithium, sodium, potassium, calcium, barium, and the like. It is preferably sodium.

<Inorganic Alkali Metal Compound (B)>

The inorganic alkali metal compound (B) is at least one selected from sodium chloride and sodium sulfate.

<Lithium Compound (C)>

The lithium compound (C) is at least one selected from lithium silicate, lithium sulfate and lithium hydroxide. The sand mold-forming additive preferably contains lithium silicate in terms of moisture resistance, and more preferably contains lithium silicate and at least one selected from lithium sulfate and lithium hydroxide.

The molar ratio of $Li_2O$ to $SiO_2$ of lithium silicate used as the lithium compound (C) is not particularity limited. The molar ratio ($SiO_2/Li_2O$) is preferably 3.0-5.0, and is more preferably 3.5-4.5.

<Blending Ratio of Sand Mold-Forming Additive>

The sand mold-forming additive contains 0.01-2.00 parts by weight of the inorganic alkali metal compound (B) per 100 parts by weight of the ionic surfactant (A). When the blending ratio of the inorganic alkali metal compound (B) is 0.01-2.00 parts by weight, excellent foaming properties and moisture resistance can be achieved.

In addition, the sand mold-forming additive can contain any amount of the lithium compound (C). The blending ratio is preferably 10-2000 parts by weight of the lithium compound (C) per 100 parts by weight of the ionic surfactant (A) in terms of moisture resistance.

The sand mold-forming additive can contain the alkyl sulfonic acid metal salt (A1), the alkyl sulfuric acid metal salt (A2), and a polyoxyalkylene alkyl ether sulfuric acid ester metal salt (A3), as the ionic surfactant (A), in any proportion. The sand mold-forming additive preferably contains 50-98 parts by weight of the alkyl sulfonic acid metal salt (A1), 1-40 parts by weight of the alkyl sulfuric acid metal salt (A2), and 1-40 parts by weight of the polyoxyalkylene alkyl ether sulfuric acid ester metal salt (A3), per 100 parts by weight of the total content of the alkyl sulfonic acid metal salt (A1), the alkyl sulfuric acid metal salt (A2), and the polyoxyalkylene alkyl ether sulfuric acid ester metal salt (A3).

<Sand Mold-Forming Composition>

The sand mold-forming composition contains the sand mold-forming additive, sand, and a silicate compound (D) that is a binder. The silicate compound (D) is at least one selected from sodium silicate and potassium silicate.

The sand of the sand mold-forming composition is not particularly limited such that sand grains which are conventionally known as aggregates may be used. Examples of the sand include, for example, silica sand, alumina sand, olivine sand, chromite sand, zircon sand, mullite sand. Further, various kinds of artificial sand (so-called artificial aggregate) and recycled sand may be used.

The particle size of the sand is not particularly limited. The AFS (American Foundry Society) particle size index is preferably 3-300, and is more preferably 20-200. When the AFS particle size index is equal to or greater than 3, the sand mold-forming composition has excellent fluidity, thereby improving filling property during formation of sand molds. On the other hand, when the AFS particle size index is 300 or less, air permeability of the sand mold is good.

The shape of the sand is not particularly limited and may be of any shape. The shape is preferably sphere because it has excellent flowability in order to exhibit high filling property during formation of the sand mold and because the resulting sand mold has excellent air permeability.

In order to adjust the moisture content, water may be added to the sand mold-forming composition according to the type of sand.

<Blending Ratio of the Sand Mold-Forming Composition>

The sand mold-forming composition can contain sand, the silicate compound (D), and the sand mold-forming additive in any proportion. It contains preferably 2-100 parts by weight, more preferably 5-70 parts by weight of the sand mold-forming additive, per 100 parts by weight of the silicate compound (D). In addition, the sand mold-forming composition contains preferably 1,000-100,000 parts by weight, more preferably 4,000-70,000 parts by weight, and much more preferably 7,000-30,000 parts by weight of sand per 100 parts by weight of the silicate compound (D).

<Other Additives>

Other conventionally known additives may be added to the sand mold-forming composition according to the purpose. For example, such additives include curing agents that promote solidification of the sand mold-forming composition during manufacture of sand molds.

<Sand Mold>

The sand mold is formed by molding the sand mold-forming composition and contains the sand mold-forming additive, the silicate compound (D), and sand.

<Sand Mold Manufacturing Method>

The sand mold-forming composition is prepared by mixing the materials described above, but the order and method of mixing are not particularly limited. For example, after mixing the sand mold-forming additive with the silicate compound (D), the mixture may be added to the sand. Alternatively, all materials may be mixed at the same time. Conventionally known mixing apparatuses can be used without being particularly limited, as a mixing apparatus for adding the sand mold-forming additive and the silicate compound (D) to sand and then mixing and stirring the mixture. The apparatus may be a batch type mixing apparatus or a continuous type mixing apparatus.

The molding of the sand mold-forming composition may be carried out either by hand-filling or by a molding machine. Conventionally known molding machines can be used as the molding machine without being particularly limited. Concrete examples of the molding machine include, for example, a jolt molding machine, a jolt-squeeze molding machine, a blow-squeeze molding machine, a static pressure molding machine, a core molding machine, and the like.

The filling of the sand mold-forming composition into the metal mold is preferably performed by pressing the foamed sand mold-forming composition (also referred to as a foamed composition, hereinafter) into the mold making space in the heated metal mold and is more preferably performed by injection.

The methods of filling the foamed composition into the mold making space include direct pressurization by the piston in the cylinder, filling by supplying compressed air into the cylinder, pumping by a screw or the like, and flushing, etc. The filling by direct pressurization by the piston or compressed air is preferable because of the filling stability due to filling speed and uniform pressurization to the foamed composition.

Although the method of solidifying the foamed composition filled in the mold making space of the metal mold is not particularly limited, evaporation of the foamed composition is preferable. Evaporation of the moisture from the foamed composition may be carried out, for example, by heat transfer from the metal mold to the foamed composition, high temperature air flow into the mold making space, or a combination of both.

Concretely, it is preferred to produce the sand mold by a method including the following steps (1) to (5):

(1) a step of mixing the sand mold-forming additive, a silicate compound (D), water, and sand to produce the sand mold-forming composition;
(2) a step of stirring and foaming the sand mold-forming composition to produce the foamed sand mold-forming composition (foamed composition);
(3) a step of filling the foamed composition into the mold making space in the metal mold;
(4) a step of evaporating moisture from the foamed composition in the mold making space to solidify the foamed composition; and
(5) a step of taking out the solidified foamed composition (sand mold) from the mold making space.

Alternatively, it is preferred to produce the sand mold by a method including the following steps (6) to (10):

(6) a step of foaming a mixture of the sand mold-forming additive, the silicate compound (D), and water to obtain the foamed mixture;
(7) a step of mixing and stirring the foamed mixture with sand to produce the foamed sand mold-forming composition (foamed composition);
(8) a step of filling the foamed composition into the mold making space in the metal mold;
(9) a step of evaporating moisture from the foamed composition in the mold making space to solidify the foamed composition; and
(10) a step of taking out the foamed composition in the solidified state (sand mold) from the mold making space.

The mixture of the sand mold-forming additive and water may be foamed in the step of (6). Then, the silicate compound (D) and the sand may be blended with the mixture in the step (7).

In the step (6), the method of producing the foamed mixture is not particularly limited. For example, a method in which a gas is supplied into a liquid to be uniformly mixed and dispersed by fluid shearing or the like, and a method in which gas is dissolved to a saturated state under pressure and bubbles are precipitated by rapidly reducing the pressure can be used.

In order to improve the filling properties of the foamed composition into the mold making space, the viscosity of the foamed composition (the sand mold-forming composition in the foamed state) when it is filled into the mold making space is preferably 0.5-3.58 Pa·s, and is more preferably 0.89-1.12 Pa·s.

It is also possible to temporarily (e.g., for one week) store the intermediate product in a sealed container or the like during or between the particular steps described above. For example, in the step (1), the sand mold-forming composition may be produced by temporarily storing the mixture of the sand mold-forming additive, the silicate compound (D), and water and then blending the mixture with sand. The foamed composition obtained in the step (2) may also be temporarily stored, and the sand mold-forming composition may be stirred until it is in the foamed state again before performing the step (3). Further, in the step (6), the mixture of the sand mold-forming additive, the silicate compound (D), and water may be temporarily stored prior to foaming, and then may be foamed to produce the foamed mixture.

The above-described embodiments are representative of the present disclosure and are not intended to limit the disclosure. The detailed description teaches various aspects of the present disclosure and is not intended to limit the scope of the disclosure. Further, each additional feature and teaching described-above may be applied and/or used separately or together with other features and teachings to provide the improved sand mold-forming additives and/or methods of manufacturing and using the same.

EXAMPLE

The present disclosure will now be described further by way of example and comparative examples, but the present disclosure is not limited thereto.

Preparation Example 1

94.80 parts by weight of sodium alkyl sulfonate (A1-1) having an alkyl group with 14-18 carbon atoms, 2.20 parts by weight of sodium alkyl sulfate (A2-1) having an alkyl group with 8-10 carbon atoms, 3.00 parts by weight of a polyoxyalkylene alkyl ether sulfate (A3-1) which has an alkyl group with 12-14 carbon atoms and in which the number of moles of ethylene oxide is 3-4, 0.100 parts by weight of sodium chloride (B-1), and 275 parts by weight of lithium silicate (C-1) in which a molar ratio ($SiO_2/Li_2O$) is 4.5, and 150 parts by weight of lithium sulfate (C-2) were uniformly mixed to prepare a sand mold-forming additive (H-1).

Preparation Examples 2-21

Sand mold-forming additives (H-2 to H-15, h-1 to h-6) of Preparation Examples 2-21 each having the corresponding composition shown in Table 1 were prepared in the same manner as the sand mold-forming additive (H-1) in Preparation Example 1.

TABLE 1

| | Sand mold-forming additive | | | | | | | | | | |
|---|---|---|---|---|---|---|---|---|---|---|---|
| | | Composition | | | | | | | | | |
| | | Ionic surfactant (A) | | | | | | | | | |
| | | Alkyl sulfonic acid metal salt (A1) | | Alkyl sulfuric acid metal salt (A2) | | Polyoxyalkylene alkyl ether sulfuric acid ester metal salt (A3) | | Inorganic alkali metal compound (B) | | Lithium compound (C) | |
| Preparation Example | Kind | Kind | Parts by weight | Kind | Parts by weight | Kind | Parts by weight | Kind | Parts by weight | Kind | Parts by weight |
| 1 | H-1 | A1-1 | 94.80 | A2-1 | 2.20 | A3-1 | 3.00 | B-1 | 0.100 | C-1 | 275 |
| | | | | | | | | | | C-2 | 150 |
| 2 | H-2 | A1-1 | 94.80 | A2-1 | 2.20 | A3-1 | 3.00 | B-1 | 0.100 | C-1 | 275 |
| | | | | | | | | B-2 | 0.100 | C-2 | 150 |
| 3 | H-3 | A1-2 | 60.00 | A2-2 | 10.00 | A3-2 | 30.00 | B-1 | 0.020 | C-1 | 160 |
| | | | | | | | | | | C-2 | 100 |
| 4 | H-4 | A1-1 | 95.50 | A2-3 | 2.30 | A3-1 | 2.20 | B-1 | 1.000 | C-1 | 40 |
| | | | | | | | | | | C-3 | 4 |
| 5 | H-5 | A1-1 | 60.00 | A2-3 | 30.00 | A3-1 | 10.00 | B-2 | 0.100 | C-1 | 100 |
| | | | | | | | | | | C-3 | 75 |
| 6 | H-6 | A1-1 | 92.00 | A2-1 | 8.00 | — | 0 | B-1 | 0.400 | C-1 | 1100 |
| | | | | | | | | | | C-2 | 600 |
| 7 | H-7 | A1-2 | 94.00 | — | 0 | A3-2 | 6.00 | B-1 | 1.500 | C-1 | 250 |
| | | | | | | | | | | C-2 | 150 |
| 8 | H-8 | — | 0 | A2-1 | 37.00 | A3-2 | 63.00 | B-2 | 0.300 | C-1 | 250 |
| | | | | | | | | | | C-2 | 150 |
| 9 | H-9 | A1-1 | 100.00 | — | 0 | — | 0 | B-1 | 0.500 | C-1 | 80 |
| | | | | | | | | | | C-3 | 48 |
| 10 | H-10 | — | 0 | A2-1 | 100.00 | — | 0 | B-2 | 0.100 | C-1 | 250 |
| | | | | | | | | | | C-2 | 150 |
| 11 | H-11 | — | 0 | — | 0 | A3-1 | 100.00 | B-1 | 0.200 | C-1 | 250 |
| | | | | | | | | | | C-2 | 62.5 |

TABLE 1-continued

| | Sand mold-forming additive | | | | | | | | | | |
|---|---|---|---|---|---|---|---|---|---|---|---|
| | | Composition | | | | | | | | | |
| | | Ionic surfactant (A) | | | | | | | | | |
| | | Alkyl sulfonic acid metal salt (A1) | | Alkyl sulfuric acid metal salt (A2) | | Polyoxyalkylene alkyl ether sulfuric acid ester metal salt (A3) | | Inorganic alkali metal compound (B) | | Lithium compound (C) | |
| Preparation Example | Kind | Kind | Parts by weight | Kind | Parts by weight | Kind | Parts by weight | Kind | Parts by weight | Kind | Parts by weight |
| 12 | H-12 | A1-1 | 100.00 | — | 0 | — | 0 | B-1 | 1.700 | C-1 | 275 |
| 13 | H-13 | A1-1 | 100.00 | — | 0 | — | 0 | B-1 | 0.500 | C-2 | 25 |
| 14 | H-14 | A1-1 | 100.00 | — | 0 | — | 0 | B-1 | 0.500 | C-3 | 187.5 |
| 15 | H-15 | A1-1 | 100.00 | — | 0 | — | 0 | B-1 | 0.500 | — | 0 |
| 16 | h-1 | — | 0 | — | 0 | A3-1 | 100.00 | B-1 | 0.005 | C-1 | 275 |
| | | | | | | | | | | C-2 | 187.5 |
| 17 | h-2 | — | 0 | — | 0 | A3-1 | 100.00 | B-1 | 2.100 | C-1 | 275 |
| | | | | | | | | | | C-2 | 187.5 |
| 18 | h-3 | — | 0 | — | 0 | A3-1 | 100.00 | b-1 | 0.200 | C-1 | 275 |
| | | | | | | | | | | C-2 | 187.5 |
| 19 | h-4 | — | 0 | — | 0 | A3-1 | 100.00 | b-2 | 0.200 | C-1 | 275 |
| | | | | | | | | | | C-2 | 187.5 |
| 20 | h-5 | — | 0 | — | 0 | A3-1 | 100.00 | b-3 | 0.200 | C-1 | 275 |
| | | | | | | | | | | C-2 | 187.5 |
| 21 | h-6 | — | 0 | — | 0 | A3-1 | 100.00 | b-4 | 0.200 | C-1 | 275 |
| | | | | | | | | | | C-2 | 187.5 |

The components shown in Table 1 are described below.

[Alkyl Sulfonic Acid Metal Salt (A1)]

A1-1: Sodium alkyl sulfonate having a C14-C18 alkyl group 1-2: Sodium alkyl sulfonate having a C8-C14 alkyl group

[Alkyl Sulfuric Acid Metal Salt (A2)]

A2-1: Sodium alkyl sulfate having a C8-C10 alkyl group

A2-2: Sodium alkyl sulfate having a C10-C14 alkyl group

A2-3: Sodium alkyl sulfate having a C14-C18 alkyl group

[Polyoxyalkylene Alkyl Ether Sulfuric Acid Ester Metal Salt (A3)]

A3-1: Sodium polyoxyethylene alkyl ether sulfate which has a C12-C14 alkyl group and in which the number of moles of ethylene oxide is 3-4.

A3-2: Sodium polyoxyethylene alkyl ether sulfate which has a C10-C12 alkyl group and in which the number of moles of ethylene oxide is 3-4.

[Inorganic Alkali Metal Compound (B)]

B-1: Sodium chloride

B-2: Sodium sulfate b-1: Potassium chloride b-2: Calcium chloride b-3: Potassium sulfate b-4: Calcium sulfate

[Lithium Compound (C)]

C-1: Lithium silicate (molar ratio ($SiO_2/Li_2O$) is 4.5)

C-2: Lithium sulfate

C-3: Lithium hydroxide

Example 1

42.0 parts by weight of the sand mold-forming additive (H-1), 100 parts by weight of sodium silicate (silicate compound (D)), 450 parts by weight of water, and 15,000 parts by weight of sand ("GREEN BEADS AFS: 90" made by Kinsei Matec Co., Ltd.) were mixed to a total of 2,000 g. The mixture was then stirred in a table mixer until it was foamed to obtain a foamed sand-molding forming composition (N-1).

Examples 2-15, Comparative Examples 1-6

The sand mold-forming compositions (N-2 to N-15, n-1 to n-6) of Examples 2-15 and Comparative Examples 1-6 each having the corresponding composition shown in Table 2 were prepared in the same manner as the sand mold-forming composition (N-1) of Example 1.

TABLE 2

| | | Sand mold-forming composition | | | | | |
|---|---|---|---|---|---|---|---|
| | | | Sand mold-forming additive | | Silicate compound (D) | Water | Sand |
| | | Kind | Kind | Parts by weight | (Parts by weight) | (Parts by weight) | (Parts by weight) |
| Example | 1 | N-1 | H-1 | 42.0 | 100 | 450 | 15000 |
| | 2 | N-2 | H-2 | 42.0 | 100 | 450 | 15000 |
| | 3 | N-3 | H-3 | 18.0 | 100 | 450 | 15000 |
| | 4 | N-4 | H-4 | 7.2 | 100 | 350 | 15000 |

TABLE 2-continued

| | | Sand mold-forming composition | | | | | |
|---|---|---|---|---|---|---|---|
| | | | Sand mold-forming additive | | Silicate compound (D) | Water | Sand |
| | | Kind | Kind | Parts by weight | (Parts by weight) | (Parts by weight) | (Parts by weight) |
| | 5 | N-5 | H-5 | 48.0 | 100 | 450 | 8000 |
| | 6 | N-6 | H-6 | 36.0 | 100 | 450 | 15000 |
| | 7 | N-7 | H-7 | 40.0 | 100 | 500 | 15000 |
| | 8 | N-8 | H-8 | 40.0 | 100 | 500 | 15000 |
| | 9 | N-9 | H-9 | 57.0 | 100 | 450 | 15000 |
| | 10 | N-10 | H-10 | 40.0 | 100 | 450 | 15000 |
| | 11 | N-11 | H-11 | 33.0 | 100 | 450 | 27000 |
| | 12 | N-12 | H-12 | 30.0 | 100 | 450 | 15000 |
| | 13 | N-13 | H-13 | 10.0 | 100 | 450 | 15000 |
| | 14 | N-14 | H-14 | 23.0 | 100 | 450 | 15000 |
| | 15 | N-15 | H-15 | 8.0 | 100 | 450 | 15000 |
| Comparative Example | 1 | n-1 | h-1 | 45.0 | 100 | 450 | 15000 |
| | 2 | n-2 | h-2 | 45.0 | 100 | 450 | 15000 |
| | 3 | n-3 | h-3 | 45.0 | 100 | 450 | 15000 |
| | 4 | n-4 | h-4 | 45.0 | 100 | 450 | 15000 |
| | 5 | n-5 | h-5 | 45.0 | 100 | 450 | 15000 |
| | 6 | n-6 | h-6 | 45.0 | 100 | 450 | 15000 |

The foaming property (fluidity) and moisture resistance (flexural strength) of the sand mold-forming compositions (N-1 to N-15, n-1 to n-6) were evaluated by the following tests. The results are shown in Table 3.

<Forming Property (Fluidity) Test>

The foamed sand mold-forming composition is charged into a cylindrical container having 42 mm inner diameter, a lower end of which is closed with a disk (4 mm in thickness) having a through-hole with 6 mm diameter at the center, and then a cylindrical weight having 1 kg weight and 40 mm diameter was disposed thereon. While the sand mold-forming composition in the cylindrical container is pressurized by the weight and discharged from the through-hole, the time required for the weight to move downward by 50 mm was measured, and the viscosity of the sand mold-forming composition was calculated by the following formula. The calculated viscosity was used to evaluate foaming property.

Formula: $\mu=\pi D^4 Ppt/128\ L_1 L_2 S$

μ: Viscosity [Pa·s]

D: Diameter of the through-hole [m]

Pp: Pressure of the weight [Pa]

t: Time required to move the weight by 50 mm [s]

$L_1$: Movement distance of the weight [m]

$L_2$: Thickness of the disk (the length of the through-hole) [m]

S: Average value of the area of the bottom of the weight and the cross-sectional area of the hollow space in the cylindrical container (the area of the circular cross-section perpendicular to the central axis) [$m^2$]

(Evaluation Criteria of Foaming Property)

4: 0.89 to 1.12 [Pa·s]

3: 1.13 to 1.34 [Pa·s]

2: 1.35 to 3.58 [Pa·s]

1: 3.59 or more [Pa·s]

<Moisture Resistance (Flexural Strength) Test>

The foamed sand mold-forming composition was injected into a metal mold heated to 250° C. in a mold manufacturing machine (a molding machine made by Sintokogio, Ltd.). The metal mold was a metal mold for making flexural strength test pieces and had a cavity with about 80 $cm^3$ volume. The composition was injected at 1 m/sec gate speed and 0.4 MPa pressure by the cylinder. The sand mold-forming composition filled in this heated metal mold was maintained for 2 minutes to evaporate moisture by the heat of the metal mold and solidify the sand mold-forming composition. After completion of the solidification, the sand mold was taken out from the metal mold. A 10 mm×10 mm×70 mm flexural strength test piece was made from the resulting mold. After storing the flexural strength test piece for 1 hour at a temperature of 20° C. and a humidity of 60%, or after storing the test piece for 168 hours in a thermo-hygrostat at a temperature of 35° C. and a humidity of 75%, the flexural strength (MPa) was measured. The flexural strength was measured according to JACT Test Method SM-1, Flexural Strength Test Method. The measured flexural strength was used to evaluate the moisture resistance.

(Evaluation Criteria of Moisture Resistance)

5: 3.51 to 4.00 MPa

4: 3.26 to 3.50 MPa

3: 3.01 to 3.25 MPa

2: 2.50 to 3.00 MPa

1: less than 2.49 MPa

TABLE 3

| | | | Results | | |
|---|---|---|---|---|---|
| | | Sand mold-forming composition | Foaming Property | Moisture Resistance (Flexural strength) 1 h | Moisture Resistance (Flexural strength) 168 h |
| Example | 1 | N-1 | 4 | 5 | 5 |
| | 2 | N-2 | 4 | 5 | 5 |
| | 3 | N-3 | 4 | 5 | 5 |
| | 4 | N-4 | 4 | 5 | 5 |
| | 5 | N-5 | 4 | 5 | 5 |
| | 6 | N-6 | 3 | 5 | 5 |
| | 7 | N-7 | 3 | 5 | 5 |
| | 8 | N-8 | 3 | 5 | 5 |
| | 9 | N-9 | 2 | 5 | 5 |
| | 10 | N-10 | 2 | 5 | 5 |
| | 11 | N-11 | 2 | 5 | 5 |
| | 12 | N-12 | 2 | 5 | 4 |
| | 13 | N-13 | 2 | 5 | 3 |
| | 14 | N-14 | 2 | 5 | 3 |
| | 15 | N-15 | 2 | 4 | 2 |

TABLE 3-continued

| | | Sand mold-forming composition | Results: Foaming Property | Moisture Resistance (Flexural strength) 1 h | Moisture Resistance (Flexural strength) 168 h |
|---|---|---|---|---|---|
| Comparative Example | 1 | n-1 | 1 | 3 | 2 |
| | 2 | n-2 | 1 | 3 | 2 |
| | 3 | n-3 | 1 | 3 | 1 |
| | 4 | n-4 | 1 | 3 | 1 |
| | 5 | n-5 | 1 | 3 | 1 |
| | 6 | n-6 | 1 | 3 | 1 |

Examples 1-15 could provide sand molds having excellent foaming property (fluidity) and excellent moisture resistance. In contrast, Comparative Example 1 had poor foaming property and moisture resistance since the content ratio of the inorganic alkali metal compound (B) to the ionic surfactant (A) is too low. Comparative Example 2 had poor foaming property and moisture resistance since the content ratio of the inorganic alkali metal compound (B) to the ionic surfactant (A) is too high. Comparative Examples 3 to 6 had poor foaming property and moisture resistance because they contain neither sodium chloride nor sodium sulfate as the inorganic alkali metal compound (B).

The invention claimed is:

1. A sand mold-forming additive, comprising:

0.01-2.00 parts by weight of an inorganic alkali metal compound (B) per 100 parts by weight of an ionic surfactant (A);

wherein the ionic surfactant (A) comprises an alkyl sulfonic acid metal salt (A1), an alkyl sulfuric acid metal salt (A2), and a polyoxyalkylene alkyl ether sulfuric acid ester metal salt (A3);

wherein the alkyl sulfonic acid metal salt (A1) comprises an alkyl sulfonic acid metal salt having a C8-C22 alkyl group;

wherein the alkyl sulfuric acid metal salt (A2) comprises an alkyl sulfuric acid metal salt having a C8-C22 alkyl group;

wherein the polyoxyalkylene alkyl ether sulfuric acid ester metal salt (A3) comprises a polvoxyalkylene alkyl ether sulfuric acid ester metal salt having a C8-C16 alkyl group;

wherein the inorganic alkali metal compound (B) comprises at least one selected from sodium chloride and sodium sulfate; and wherein the alkyl sulfonic acid metal salt (A1) is 50-98 parts by weight, the alkyl sulfuric acid metal salt (A2) is 1-40 parts by weight, and the polyoxyalkylene alkyl ether sulfuric acid ester metal salt (A3) is 1-40 parts by weight, per 100 parts by weight of total content of the alkyl sulfonic acid metal salt (A1), the alkyl sulfuric acid metal salt (A2), and the polyoxyalkylene alkyl ether sulfuric acid ester metal salt (A3).

2. The sand mold-forming additive according to claim 1, further comprising a lithium compound (C) comprising at least one selected from lithium silicate, lithium sulfate and lithium hydroxide.

3. The sand mold-forming additive according to claim 2, wherein the lithium compound (C) comprises lithium silicate, and at least one selected from lithium sulfate and lithium hydroxide.

4. The sand mold-forming additive according to claim 2, wherein the lithium compound (C) is 10-2,000 parts by weight per 100 parts by weight of the ionic surfactant (A).

5. The sand mold-forming additive according to claim 2, wherein the lithium compound (C) comprises lithium silicate; and wherein a molar ratio ($SiO_2/Li_2O$) of the lithium silicate is 3.0-5.0.

6. A sand mold-forming composition, comprising the sand mold-forming additive according to claim 4, sand, and a silicate compound (D) comprising at least one selected from sodium silicate and potassium silicate.

7. The sand mold-forming composition according to claim 6, wherein the sand mold-forming additive is 2-100 parts by weight per 100 parts by weight of the silicate compound (D).

8. A method of manufacturing a sand mold, comprising:

a step A of molding the sand mold-forming composition according to claim 6.

9. The method of manufacturing the sand mold according to claim 8, wherein the step A comprises:

a step A1 of stirring and foaming the sand mold-forming composition according to claim 6;

a step A2 of filling the foamed sand mold-forming composition into a mold making space; and a step A3 of solidifying the filled sand mold-forming composition.

10. A method of manufacturing a sand mold, comprising:

a step B1 of adding a silicate compound (D) to the sand mold-forming additive according to claim 1, stirring and foaming the mixture, and then adding sand to the mixture;

a step B2 of filling the prepared sand mold-forming composition into a mold making space; and a step B3 of solidifying the filled sand mold-forming composition.

11. A sand mold, comprising the sand mold-forming additive according to claim 1, a silicate compound (D), and sand wherein the silicate compound (D) comprises at least one selected from sodium silicate and potassium silicate.

12. The sand mold-forming additive according to claim 1, wherein the alkyl sulfonic acid metal salt (A1) comprises a sodium alkyl sulfonate having a C14-C18 alkyl group, or a sodium alkyl sulfonate having a C8-C14 alkyl group.

13. The sand mold-forming additive according to claim 1, wherein the alkyl sulfuric acid metal salt (A2) comprises a sodium alkyl sulfate having a C8-C10 alkyl group, a sodium alkyl sulfate having a C10-C14 alkyl group, or a sodium alkyl sulfate having a C14-C18 alkyl group.

14. The sand mold-forming additive according to claim 1, wherein the polyoxyalkylene alkyl ether sulfuric acid ester metal salt (A3) comprises a sodium polyoxyethylene alkyl ether sulfate which has a C12-C14 alkyl group and in which a number of moles of ethylene oxide is 3-4, or a sodium polyoxyethylene alkyl ether sulfate which has a C10-C12 alkyl group and in which a number of moles of ethylene oxide is 3-4.

* * * * *